US010470860B2

(12) United States Patent
Kirkdoffer

(10) Patent No.: US 10,470,860 B2
(45) Date of Patent: Nov. 12, 2019

(54) PYGMY GOAT AND SMALL LIVESTOCK BIRTHING AID

(71) Applicant: Kellie Foster Kirkdoffer, Morganton, GA (US)

(72) Inventor: Kellie Foster Kirkdoffer, Morganton, GA (US)

( * ) Notice: Subject to any disclaimer, the term of this patent is extended or adjusted under 35 U.S.C. 154(b) by 996 days.

(21) Appl. No.: 14/463,945

(22) Filed: Aug. 20, 2014

(65) Prior Publication Data

US 2015/0057670 A1 Feb. 26, 2015

Related U.S. Application Data

(60) Provisional application No. 61/868,354, filed on Aug. 21, 2013.

(51) Int. Cl.
*A61D 1/08* (2006.01)

(52) U.S. Cl.
CPC ..... *A61D 1/08* (2013.01)

(58) Field of Classification Search
CPC ... A61D 1/08; A61D 1/10; A61D 1/12; Y10T 24/3987; Y10T 24/3991; Y10T 24/3705; Y10T 24/3909; Y10T 24/3907; Y10T 24/3916; Y10T 24/1986; F16G 11/00; F16G 11/02; F16G 11/025; F16G 11/04; F16G 11/044; F16G 11/05; F16G 11/08; F16G 11/10; F16G 11/101; F16G 11/103; F16G 11/105; F16G 11/12; F16G 11/14; F16G 11/143; F16G 11/146; A63B 2/042; A63B 2/0552; A63B 2/0555; A63B 2/0557; A63B 2/065; A63B 2/4009; A63B 2/4025; A63B 2208/0204; A01K 1/0263; A01K 1/001; A01K 27/001; A01K 27/003; A01K 15/00; A01K 15/0613; A41D 25/022; A61B 17/42; A61B 17/32056; A61B 2018/41; B63B 2021/203; B63B 2/04; B66C 1/12; B66C 1/18

USPC ..... 606/122–124; 24/115 H, 115 R, 122.6, 24/115 K, 129 R; 119/803, 802, 804; 294/150, 152, 155, 156, 74

See application file for complete search history.

(56) References Cited

U.S. PATENT DOCUMENTS 2,561,487 A * 7/1951 Bailhe ..... B63B 21/20 114/230.26
2,709,438 A * 5/1955 Murray ..... A61D 1/08 24/115 H
3,988,850 A * 11/1976 Steinman ..... A01K 87/00 24/115 H (Continued)

*Primary Examiner* — Diane D Yabut
*Assistant Examiner* — Majid Jamialahmadi

(57) ABSTRACT

A pygmy goat and small breed livestock birthing aid to assist in the positioning of the newborn during the birthing process. The birthing aid includes a flexible cable, at least one flexible sleeve, and a cable clamp. The flexible cable is slideably inserted into the at least one flexible sleeve, such that there is a loop portion and a handle portion of the flexible cable opposite each other along the at least one flexible sleeve. The loop portion is placed over the neck of the newborn in the birthing process and the user pulls gently on the handle portion tightening the loop portion about the newborn. After gently guiding the newborn into the correct birthing, the user removes the birthing aid and manually assists the birthing process if necessary.

6 Claims, 6 Drawing Sheets

(56) References Cited

U.S. PATENT DOCUMENTS 4,540,173 A * 9/1985 Hopkins, Jr. ..... A63B 21/0552
482/124
6,449,810 B1 * 9/2002 Kuwayama ..... A44C 11/005
24/115 G

* cited by examiner

PYGMY GOAT AND SMALL LIVESTOCK BIRTHING AID

The current application claims a priority to the U.S. Provisional Patent application serial number 61/868,354 filed on Aug. 21, 2013.

FIELD OF THE INVENTION

The present invention relates generally to a device in assisting in the birth of livestock. More specifically, the present invention is a device to assist in the birth of small breeds of animals, specifically pygmy goats, to properly position the newborn in the birthing process.

BACKGROUND OF THE INVENTION

When rearing livestock, farmers more often than not have to assist in the pulling of livestock from the uterus of a birthing mother, due to the position of livestock offspring within the womb. Most devices that assist in this process are used to grab the forelimbs of the animal and allow the farmer to pull the livestock offspring easily out of the uterus. Additionally, most devices which assist in the process are primarily for larger breeds of livestock.

Therefore, it is an object of the present invention to provide a livestock birthing aid which is specifically designed for small breeds of livestock. The present invention loops and tightens over the head or neck of small livestock to gently assist in positioning the newborn into the proper birthing position. The farmer or breeder is able to then manually assist the birthing process as needed.

DETAIL DESCRIPTIONS OF THE INVENTION

All illustrations of the drawings are for the purpose of describing selected versions of the present invention and are not intended to limit the scope of the present invention.

The present invention allows for the ease in assistance for the delivery process for a pygmy goat or small breeds of livestock. Helping to orient the birthing position, the present invention loops over the head or torso of the newborn, such that the birthing assistant is able to maneuver the newborn. Once the newborn is in a proper birthing position, the assistant is able to provide minor help to the mother during the birthing process.

Figure 1:
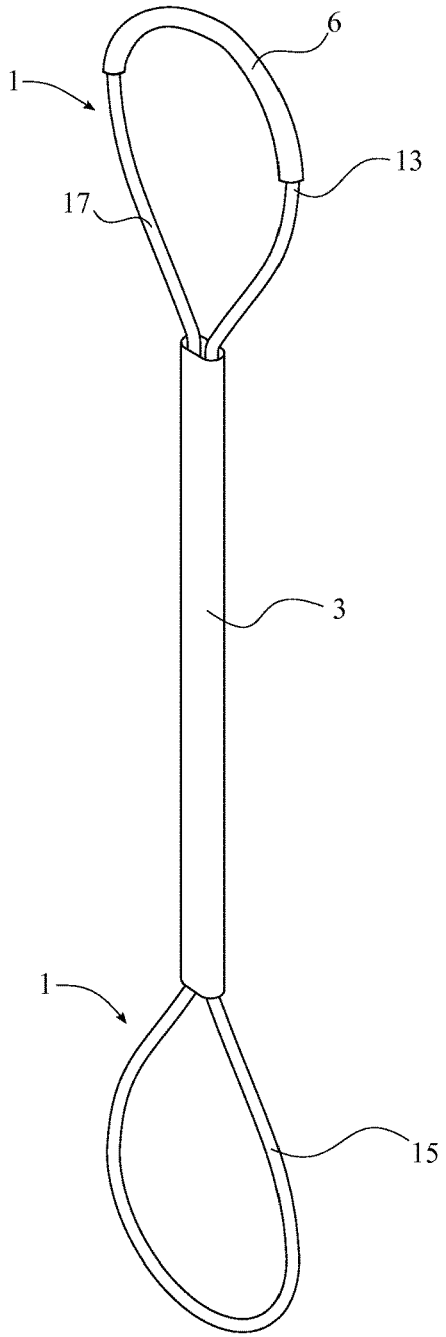
FIG. 1 is a perspective view of the present invention in its simplest embodiment.
Figure 2:
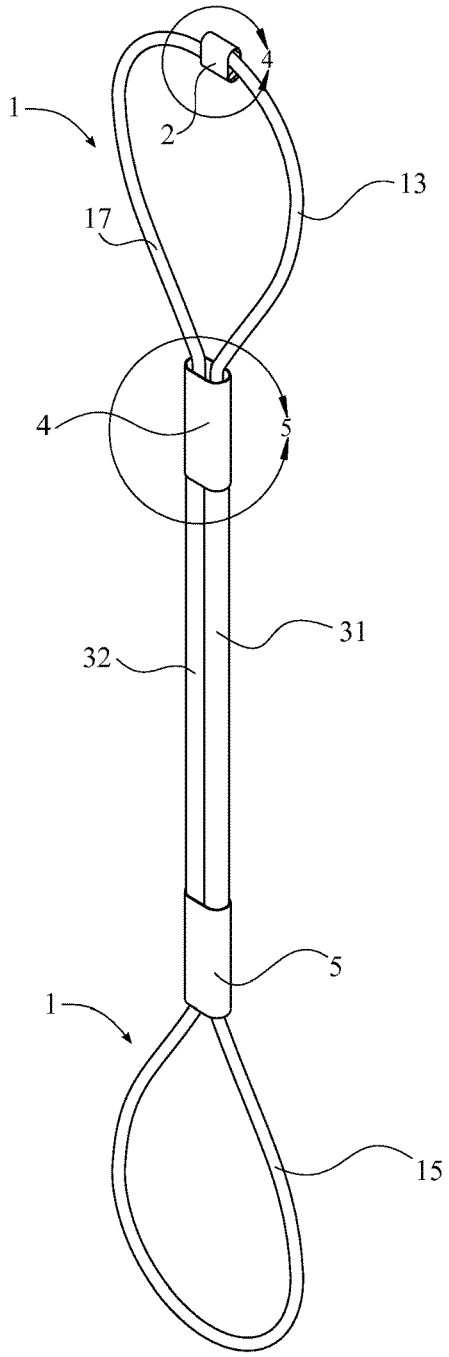
FIG. 2 is a perspective view of the present invention in its preferred embodiment, with the handle sleeve removed.
Figure 3:
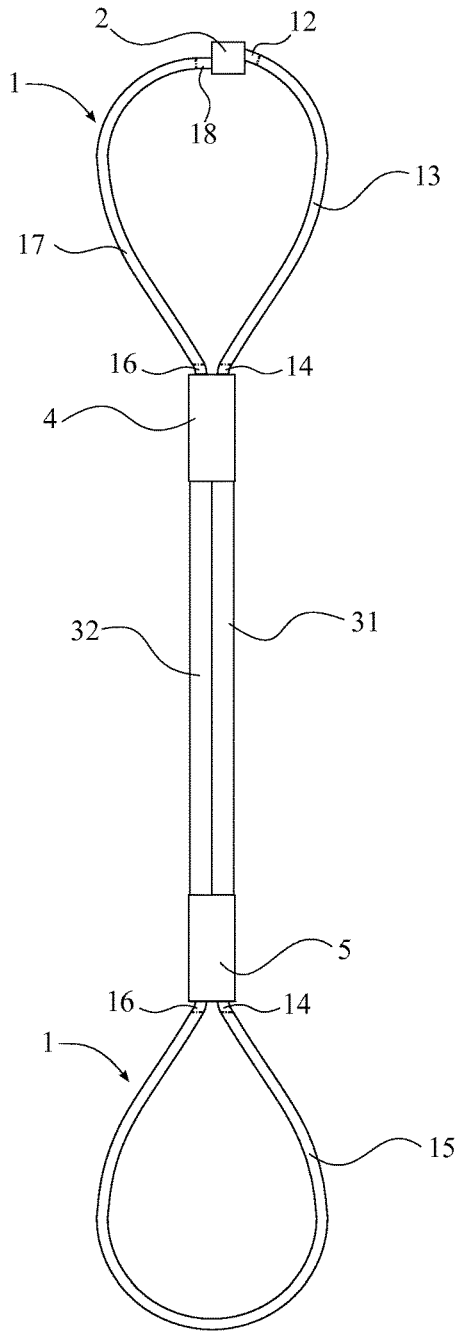
FIG. 3 is a front-side view of the preferred embodiment of the present invention, with the handle sleeve removed.
Figure 4:
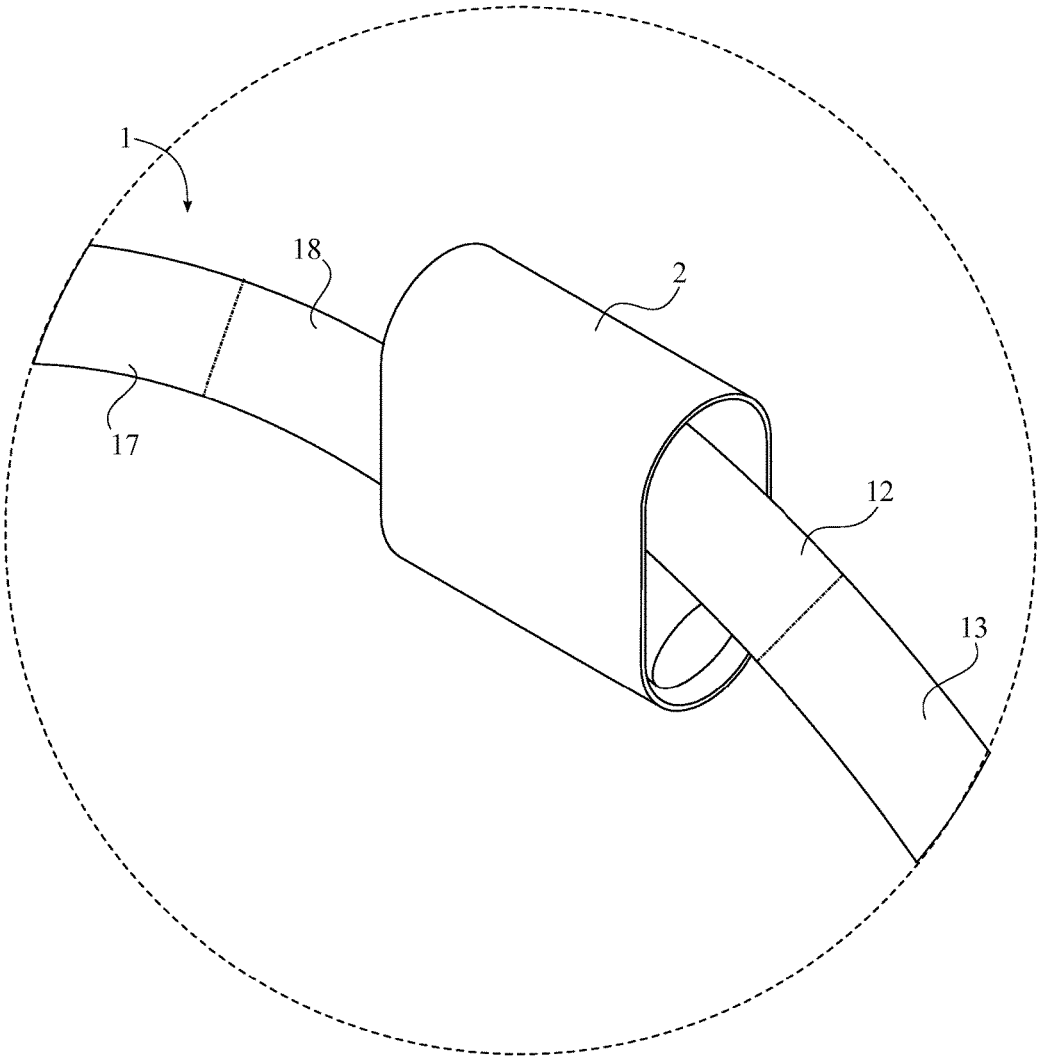
FIG. 4 is a right-perspective view of a crimping clamp to connect vinyl tubing in the preferred embodiment of the present invention, with the handle sleeve removed.

As shown in FIG. 1, the present invention comprises a flexible cable 1, a cable clamp 2, and at least one flexible sleeve 3. The flexible cable 1 is looped through the at least one flexible sleeve 3 and secured onto itself by the cable clamp 2. The flexible cable 1 comprises a first end 12, a second end 18, a first handle portion 13, first intermediate portion 14, a loop portion 15, a second end 18, a second handle portion 17, and a second intermediate portion 16. The first end 12, the first handle portion 13, the first intermediate portion 14, the loop portion 15, the second intermediate portion 16, the second handle portion 17, and the second end 18 are sequentially connected along the flexible cable 1, respectively. The first end 12 is threaded through the at least one flexible sleeve 3. Next, the first end 12 is looped back through the at least one flexible sleeve 3, creating the looped portion 15. Subsequently, the first end 12 is bound to the second end 18 by the cable clamp 2, as shown in FIG. 4. The ultimate configuration of the present invention is shown in FIG. 2 and FIG. 3. The first intermediate portion 14 and the second intermediate portion 16 are slideably positioned within the at least one flexible sleeve 3, such that the loop portion 15 varies in size when the first handle portion 13 and the second handle 17 are pulled upon. Thus, allowing the present invention to become taught around the neck of the newborn. The loop portion 15 is positioned adjacent to the at least one flexible sleeve 3. The first handle portion 13 and the second handle portion 17 are positioned adjacent to the at least one flexible sleeve 3, opposite the loop portion 15. The user pulls on the first handle portion 13 and the second handle portion 17 while keeping the at least one flexible sleeve 3 in a fixed position or sliding the at least one sleeve along the flexible cable 1 to adjust the size and tension on the loop portion 15

Figure 5:
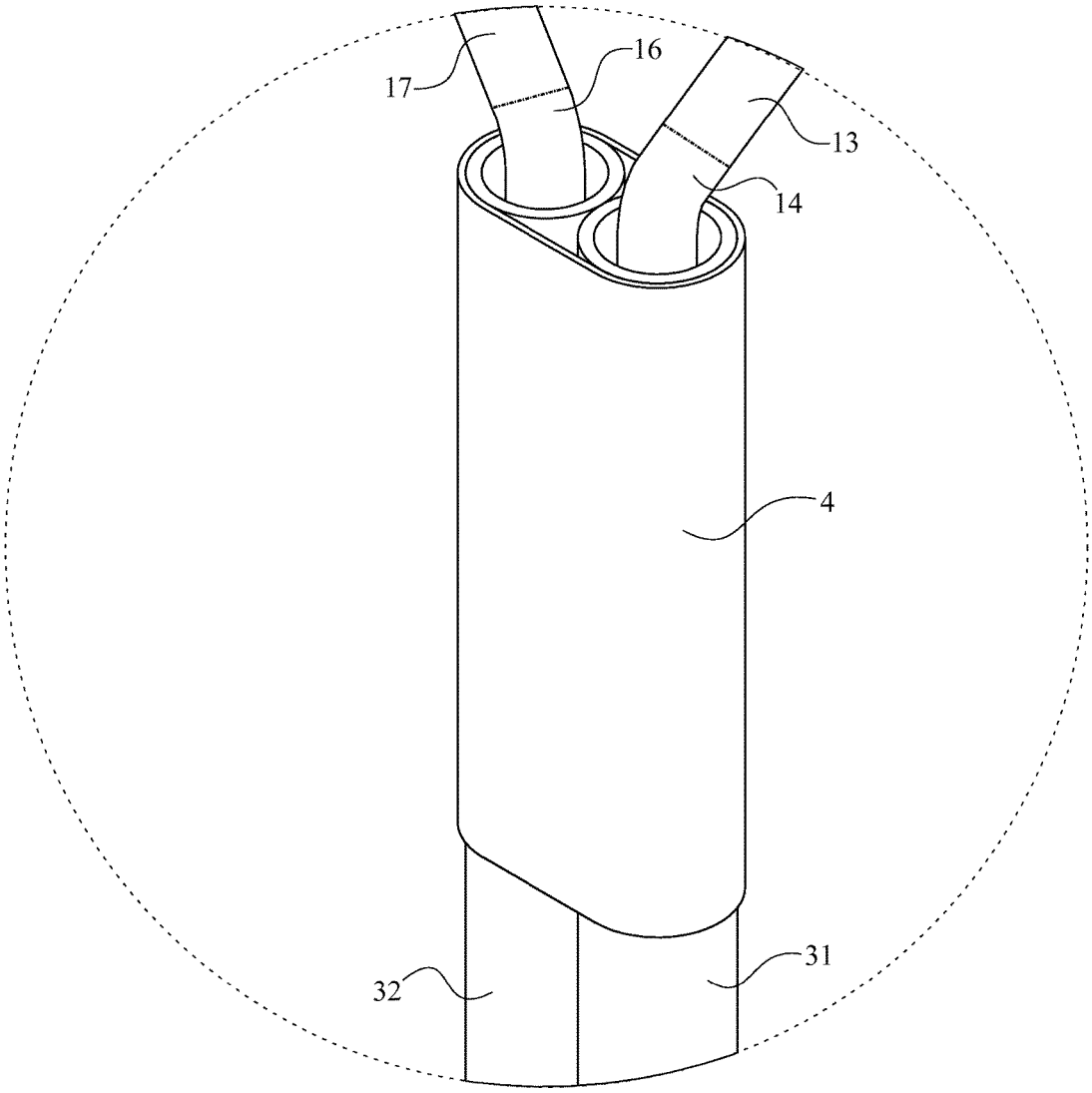
FIG. 5 is a right-perspective view of heat-shrink tubing used in the preferred embodiment of the present invention.

In the preferred embodiment, the at least one flexible sleeve 3 comprises a first sleeve 31 and a second sleeve 32. The first intermediate portion 14 is positioned within the first sleeve 31. The second intermediate portion 16 is positioned into the second sleeve 32. The first sleeve 31 is tangentially and adjacently connected along the second sleeve 32. The preferred embodiment of the present invention further comprises a proximal collar 4 and a distal collar 5. The first sleeve 31 and the second sleeve 32 are tightly encircled by the proximal collar 4 and the distal collar 5. The proximal collar 4 and the distal collar 5 are positioned opposite to each other along the at least one flexible sleeve 3. In accordance to FIG. 5, the proximal collar 4 and the distal collar 5 bind the first sleeve 31 and the second sleeve 32 together, such that one cannot move independently from the other.

Figure 6:
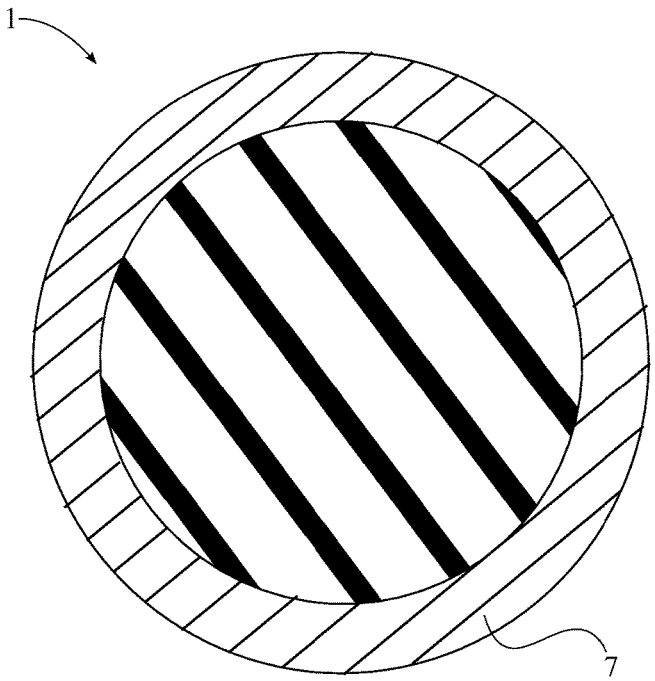
FIG. 6 is a cross-sectional view of the flexible cable of the present invention.

Further, the present invention comprises a handle sleeve 6 and a smooth coating 7. The first handle portion 13 and the second handle portion 17 are encircled by the handle sleeve 6. The handle sleeve 6 is slideably positioned along the first handle portion 13 and the second handle portion 17. The handle sleeve 6 protects the users hand when tension is drawn on the flexible cable 1 by providing a larger surface area to disperse the force on the user's hand. In accordance to FIG. 6, the flexible cable 1 is enveloped by the smooth coating 7 in order to provide a soft and gentle contact surface for the newborn livestock's neck or torso.

The following specifications for the preferred embodiment allow components of the present invention to function more effectively and efficiently. The flexible cable 1 is a clear vinyl coated galvanized cable in order to provide a gentle and soft interface with the user and the newborn to be maneuvered. The cable clamp 2 is an aluminum crimp sleeve, which provides enough strength to keep the flexible cable 1 in a loop configuration. The proximal collar 4 and the distal collar 5 are a pair of long clear shrink tubing to easily bind the sleeves together such that the present invention is easily handled. The handle sleeve 6 is made of polyvinyl chloride for comfort and ease of use for the user when applying tension to the flexible cable. The at least one flexible sleeve 3 is made of polyethylene, such that the flexible cable is easily slid through the flexible sleeve 3.

In practice, the user first determines whether or not the newborn is in a proper birthing position. If the newborn is not, the present invention is inserted into the mother's uterus, where the loop portion 15 is gently placed about the newborn's neck. The user then gently pulls on the joined first handle portion 13 and the second handle portion 17, while keeping a hand on and fixing the at least one flexible sleeve 3 in place. This allows for the loop portion 15 to retract around the newborn's neck, such that the newborn is able to be maneuvered into the proper birthing position. When done correctly, the newborn's head should be exposed, the birthing aid is removed, and the newborn has its airway cleared and is easily manipulated out from the mother. If there is difficulty, the birthing assistant may locate a shoulder of a front leg through feeling about with an index finger to assist in the birthing process.

Although the invention has been explained in relation to its preferred embodiment, it is to be understood that many other possible modifications and variations can be made without departing from the spirit and scope of the invention as hereinafter claimed.

What is claimed is:

1. A pygmy goat and small livestock birthing aid comprises:

a flexible cable;

a single cable clamp;

an at least one flexible sleeve;

the flexible cable comprises a first end, a first handle portion, a first intermediate portion, a loop portion, a second end, a second handle portion, and a second intermediate portion;

the first end, the first handle portion, the first intermediate portion, the loop portion, the second intermediate portion, the second handle portion, and the second end being sequentially formed along the flexible cable;

the first intermediate portion and the second intermediate portion being slideably positioned within the at least one flexible sleeve;

the loop portion being positioned adjacent to the at least one flexible sleeve;

the first handle portion and the second handle portion being positioned adjacent to the at least one flexible sleeve, opposite to the loop portion;

the first end and the second end are two separate and opposite ends of the flexible cable, the two separate and opposite ends being bound to each other by the single cable clamp, such that the first end, the first handle portion, the first intermediate portion, the loop portion, the second intermediate portion, the second handle portion, the second end and the single cable clamp keep the flexible cable in a loop configuration;

the at least one flexible sleeve comprises a first sleeve and a second sleeve;

the first intermediate portion being slideably positioned within the first sleeve;

the second intermediate portion being slideably positioned within the second sleeve;

the first sleeve being tangentially and adjacently connected along the second sleeve;

a proximal collar;

a distal collar;

the first sleeve and the second sleeve tightly encircled by the proximal collar and the distal collar; and the proximal collar and the distal collar being positioned opposite to each other along the at least one flexible sleeve.

2. A pygmy goat and small livestock birthing aid comprises:

a flexible cable;

a single cable clamp;

an at least one flexible sleeve;

the flexible cable comprises a first end, a first handle portion, a first intermediate portion, a loop portion, a second end, a second handle portion, and a second intermediate portion;

the at least one flexible sleeve comprises a first sleeve and a second sleeve;

the first end, the first handle portion, the first intermediate portion, the loop portion, the second intermediate portion, the second handle portion, and the second end being sequentially formed along the flexible cable;

the first intermediate portion and the second intermediate portion being slideably positioned within the at least one flexible sleeve;

the loop portion being positioned adjacent to the at least one flexible sleeve;

the first handle portion and the second handle portion being positioned adjacent to the at least one flexible sleeve, opposite to the loop portion;

the first intermediate portion being slideably positioned within the first sleeve;

the second intermediate portion being slideably positioned within the second sleeve;

the first sleeve being tangentially and adjacently connected along the second sleeve;

the first end and the second end are two separate and opposite ends of the flexible cable, the two separate and opposite ends being bound to each other by the single cable clamp, such that the first end, the first handle portion, the first intermediate portion, the loop portion, the second intermediate portion, the second handle portion, the second end and the single cable clamp keep the flexible cable in a loop configuration;

a proximal collar;

a distal collar;

the first sleeve and the second sleeve tightly encircled by the proximal collar and the distal collar; and the proximal collar and the distal collar being positioned opposite to each other along the at least one flexible sleeve.

3. A pygmy goat and small livestock birthing aid comprises:

a flexible cable;

a single cable clamp;

an at least one flexible sleeve;

a proximal collar;

a distal collar;

the flexible cable comprises a first end, a first handle portion, a first intermediate portion, a loop portion, a second end, a second handle portion, and a second intermediate portion;

the at least one flexible sleeve comprises a first sleeve and a second sleeve;

the first end, the first handle portion, the first intermediate portion, the loop portion, the second intermediate portion, the second handle portion, and the second end being sequentially formed along the flexible cable;

the first intermediate portion and the second intermediate portion being slideably positioned within the at least one flexible sleeve;

the loop portion being positioned adjacent to the at least one flexible sleeve;

the first handle portion and the second handle portion being positioned adjacent to the at least one flexible sleeve, opposite to the loop portion;

the first intermediate portion being slideably positioned within the first sleeve;

the second intermediate portion being slideably positioned within the second sleeve;

the first sleeve being tangentially and adjacently connected along the second sleeve;

the first sleeve and the second sleeve tightly encircled by the proximal collar and the distal collar;

the proximal collar and the distal collar being positioned opposite to each other along the at least one flexible sleeve; and the first end and the second end are two separate and opposite ends of the flexible cable, the two separate and opposite ends being bound to each other by the single cable clamp, such that the first end, the first handle portion, the first intermediate portion, the loop portion, the second intermediate portion, the second handle portion, the second end and the single cable clamp keep the flexible cable in a loop configuration.

4. The pygmy goat and small livestock birthing aid as claimed in claim 3 comprises:

a smooth coating; and the flexible cable being enveloped by the smooth coating.

5. The pygmy goat and small livestock birthing aid as claimed in claim 3 comprises:

a handle sleeve;

the first handle portion and the second handle portion being encircled by the handle sleeve; and the handle sleeve being slideably positioned along the first handle portion and the second handle portion.

6. The pygmy goat and small livestock birthing aid as claimed in claim 5 comprises:

the handle sleeve being made of polyvinyl chloride;

the flexible cable being a clear vinyl coated galvanized cable;

the at least one flexible sleeve being made of polyethylene;

the single cable clamp being an aluminum crimp sleeve; and the proximal collar and the distal collar being a pair of long clear shrink tubing.

* * * * *